US005649333A

United States Patent [19]

Chernjawski

[11] Patent Number: 5,649,333

[45] Date of Patent: Jul. 22, 1997

[54] RAPID ARTICULATED PONTOON BRIDGE

[76] Inventor: Michael Chernjawski, 489 Essex St, Apt 6, Hackensack, N.J. 07601

[21] Appl. No.: 600,541

[22] Filed: Feb. 13, 1996

[51] Int. Cl.[6] ..... E01D 15/20

[52] U.S. Cl. ..... 14/27; 114/259

[58] Field of Search ..... 14/2.4, 2.6, 27; 405/66, 67, 68; 52/182, 183; 242/388.6, 388.7, 388.8; 114/77 R, 258, 259

[56] References Cited

U.S. PATENT DOCUMENTS

| | | | |
|---|---|---|---|
| 3,520,489 | 7/1970 | Flowers | 242/86.5 |
| 3,800,721 | 4/1974 | Taylor | 114/0.5 F |
| 4,027,800 | 6/1977 | Polen | 212/14 |
| 4,386,441 | 6/1983 | Lundholm | 14/27 |
| 4,493,284 | 1/1985 | Echtler . | |
| 4,730,574 | 3/1988 | Diefendahl . | |
| 4,754,723 | 7/1988 | Ghering | 114/353 |
| 4,886,441 | 12/1989 | Lundholm . | |

FOREIGN PATENT DOCUMENTS

| | | | |
|---|---|---|---|
| 2489389 | 5/1982 | France | 14/27 |
| 336873 | 10/1930 | United Kingdom | 114/77 |

*Primary Examiner*—Tamara L. Graysay
*Assistant Examiner*—Tony Boyd

[57] ABSTRACT

The articulated pontoon floating bridge arrangement comprising plurality of pivotably interconnected pontoon modules. The actuation means installed inside of each module facilitate rapid folding and unfolding operation. Pontoon modules when unfolded in extended position provide articulated pontoon bridge arrangement used for vehicular traffic applications. When transported, the pontoon modules assembly is folded together in upstanding vertical juxtaposition and towed or transported rapidly and safely in a pontoon carrier to the operating site.

7 Claims, 6 Drawing Sheets

RAPID ARTICULATED PONTOON BRIDGE

BACKGROUND OF THE INVENTION

Present invention relates to the field of floating articulated pontoon bridges using pivotable electromechanical actuation means for rapid folding and unfolding of interconnected pontoon modules.

Articulated floating pontoon arrangements based on pivotable interconnections is known in the prior art. Due to lack of actuation means, the major disadvantage of previous folding pontoon arrangements when at sea is a lengthy and cumbersome folding and unfolding operation requiring significant expenditure of manpower. One of the disadvantages of previous folding pontoon arrangements is limited number of pontoon modules that can be interconnected together resulting in a short folding pontoon assembly length, which in most cases is not adequate when operating in regions with no port facilities. Another disadvantage of prior folding pontoon arrangements is the necessity of crane assistance to carry out folding and unfolding of pontoon operations. In case of emergency situation, the slow folding operation used in previous folding pontoon arrangements may result in a loss of entire pontoon assembly.

SUMMARY OF THE INVENTION

A great need is at present being found for cargo ships trading in regions with no port facilities. Given such conditions, it is desirable to have a folding pontoon arrangement capable to be rapidly deployed and facilitate rapid loading and unloading of cargo ships in the absence of port facilities.

It is an object of this invention, to assemble and pivotally interconnect the pontoon modules together in port thus eliminating lengthy and cumbersome pontoon module assembly in a sea state environment.

An important object of the present invention is to provide a novel construction of pivoting electromechanical actuation means installed in the interior of each pontoon module to facilitate rapid folding and unfolding operation in a sea environment eliminating intensive manual effort.

Another object of this invention, is the capability of the interconnected pontoon modules to be folded together in a vertical juxtaposition configuration comprising interconnected hinged pontoon modules capable to be towed, or safely transported in a pontoon carrier.

Another object of this invention is the capability of interconnected pontoon modules to be rapidly unfolded into an extended pontoon configuration.

Another object of this invention is to provide a vehicular roadway capability of the pontoon modules utilizing the top decks.

Another object of this invention is to provide a vehicular roadway capability utilizing bottom decks of interconnected pontoon modules when turned 180 degrees about the longitudinal axis (x-axis) of the pontoon modules arrangement.

It is an object of this invention to provide each pontoon module with electric power from a shipboard power supply main.

It is an object of this invention to provide a capability of automatic control system to be installed in the pontoon carrier, to control the operation of entire pontoon modules system.

Another object of this invention is to provide elastic fenders mounted on decks and end walls of each module, and shock absorber means installed inside of each pontoon module to form a flexible system, capable to absorb impact loads due to folding and unfolding of pontoon modules when operating in a sea state environment.

Another object of this invention is to provide a rapid folding capability of the articulated pontoon bridge assembly in case of emergency situation.

It is an object of this invention to provide pontoon modules with buoyant watertight compartmentation arrangement to prevent the pontoon modules from flooding in case of accidental damage.

Another object of the invention is to provide a manually actuated emergency means installed in the interior of each module to actuate the pontoon modules in case of emergency situation.

Variation of the invention suggests that the rapid articulated pontoon assembly can be linked to other assembled pontoon modules.

BRIEF DESCRIPTION OF THE DRAWINGS

The invention is explained in more detail in the embodiments shown in the drawings.

DETAILED DESCRIPTION OF THE INVENTION

Figure 4:
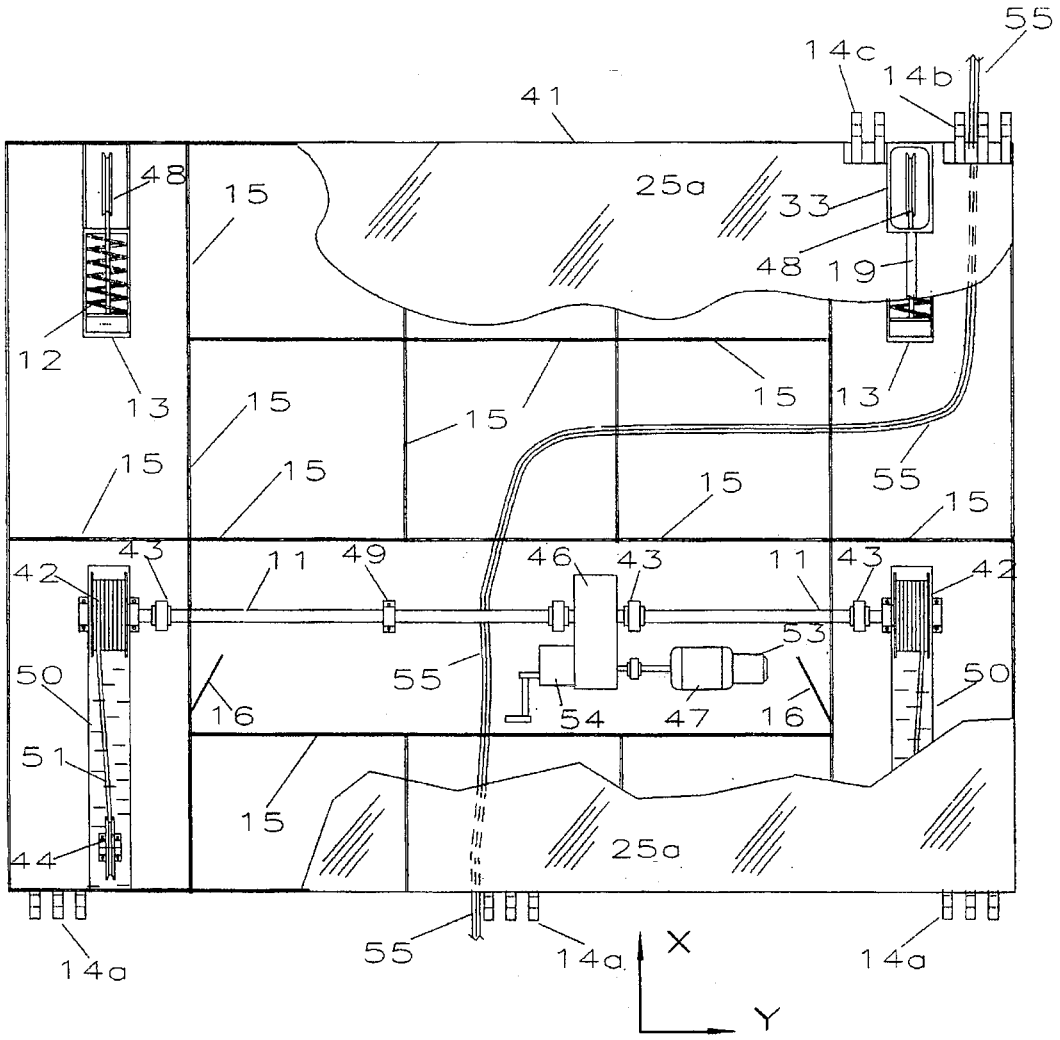
FIG. 4 shows a top plan view of pontoon module constructed in accordance with the invention with partially broken away top deck plating to illustrate the interior construction of the module.
Figure 5:
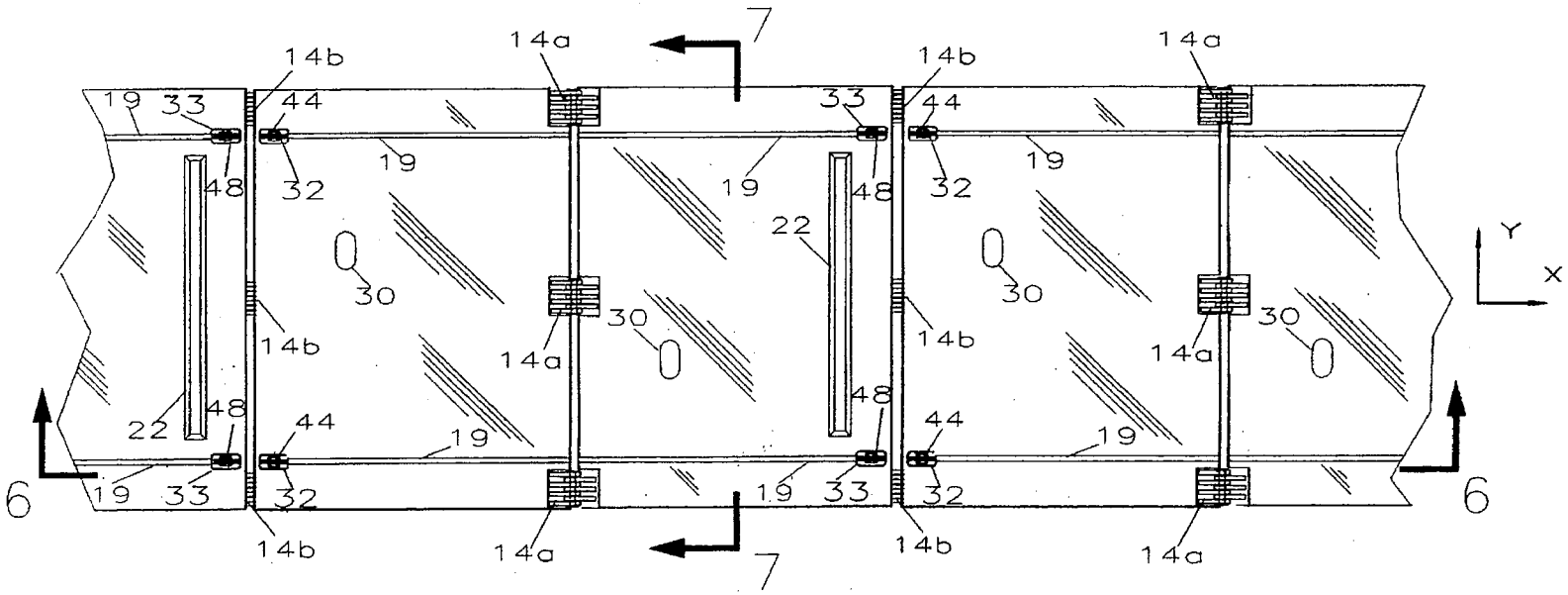
FIG. 5 shows a top view of hinged together pontoon modules in extended position.

A pontoon module 41 (FIG. 4) is a fully watertight welded structure which is subdivided into a plurality of watertight compartments. Compartments serve as buoyancy chambers and housing of pivotal electromechanical actuation means and shock absorber means. Compartmentation is used also to provide basic strength of a module. Each pontoon module is furnished with a top deck 25*a*, bottom deck 25*b*, end walls 35, 36 and side walls which are reinforced with interior longitudinal and transverse bulkheads 15 (FIGS. 4,7,8,9). Pontoon top and bottom decks 25*a* and 25*b* are designed to withstand vehicular wheel loads. Top and bottom decks of each module are provided with raised non slip antiskid pattern welded to the deck plating (not shown). For accessibility to interior of each module, the top decks and bottom decks are provided with watertight manholes 30 used when the pontoon modules are in extended configuration (FIG. 5). End walls of each module are provided with watertight manholes 34*a* used when in folded vertical juxtaposition configuration (FIG. 10). Watertight doors 16 in the interior of each module are provided for accessibility of winch machinery spaces (FIG. 4). Top and bottom decks 25*a* and 25*b* are provided with wire rope troughs 19 (FIGS. 4,5,7,8,9) used to protect the winch wire ropes 51 and 52 from vehicular wheel loads.

Figure 7:
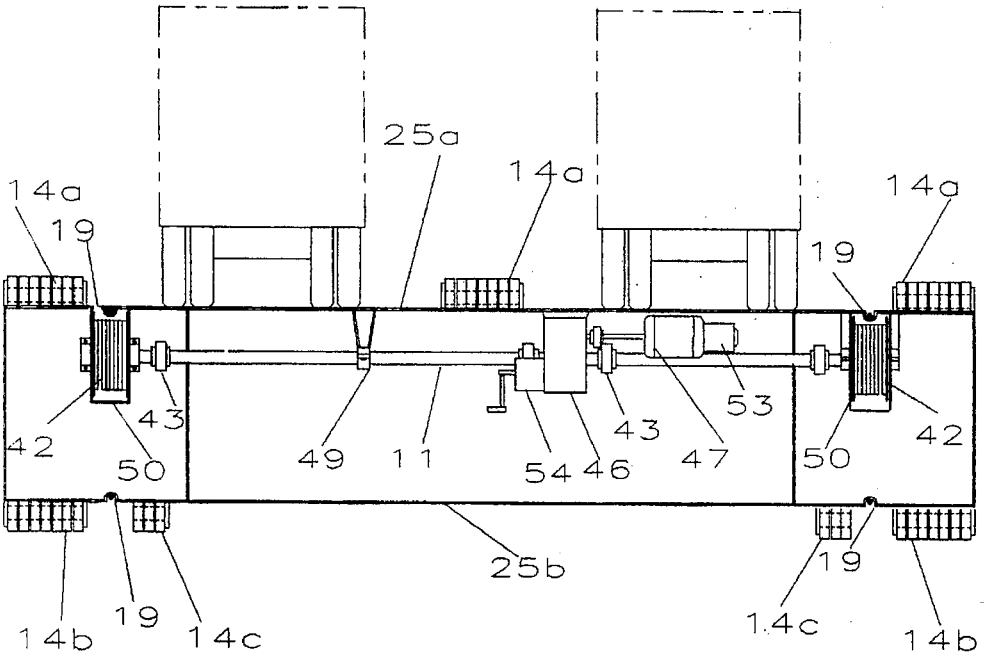
FIG. 7 shows a transverse cross section of pontoon module illustrated in FIG. 5 with top decks used for vehicular traffic.

When in extended mode, the top pontoon decks 25*a* are used for two way vehicular roadway as shown in FIG. 7.

Figure 6:
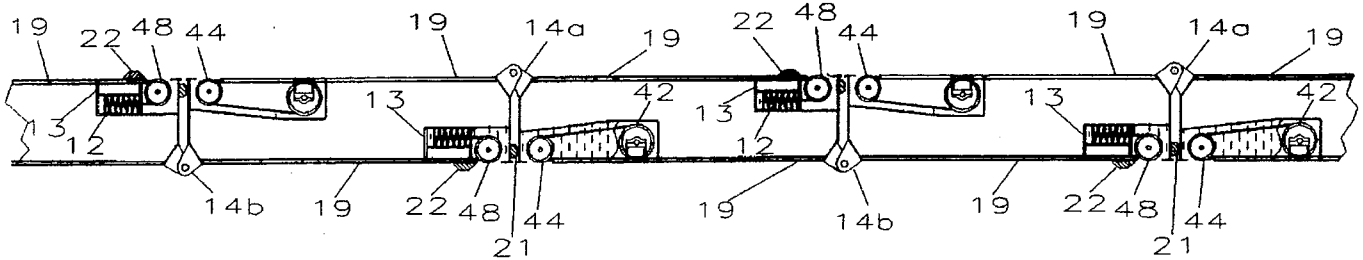
FIG. 6 shows a longitudinal cross section of interconnected pontoon modules illustrated in FIG. 5.
Figure 8:
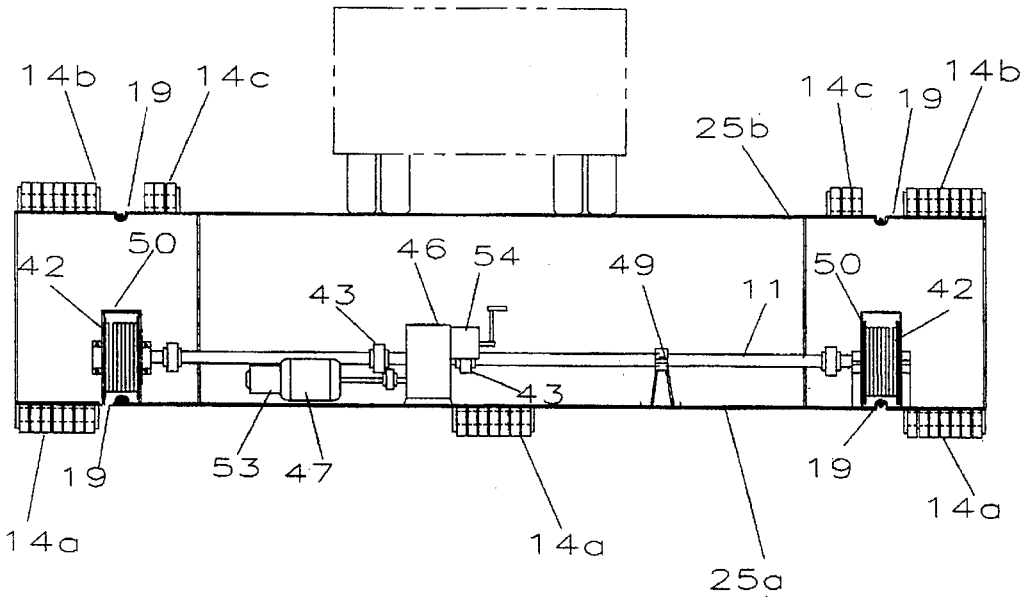
FIG. 8 shows transverse cross section of pontoon module illustrated in FIG. 5 turned 180 degrees about pontoon longitudinal axis (X-axis) with bottom decks used for wide vehicular traffic.
Figure 9:
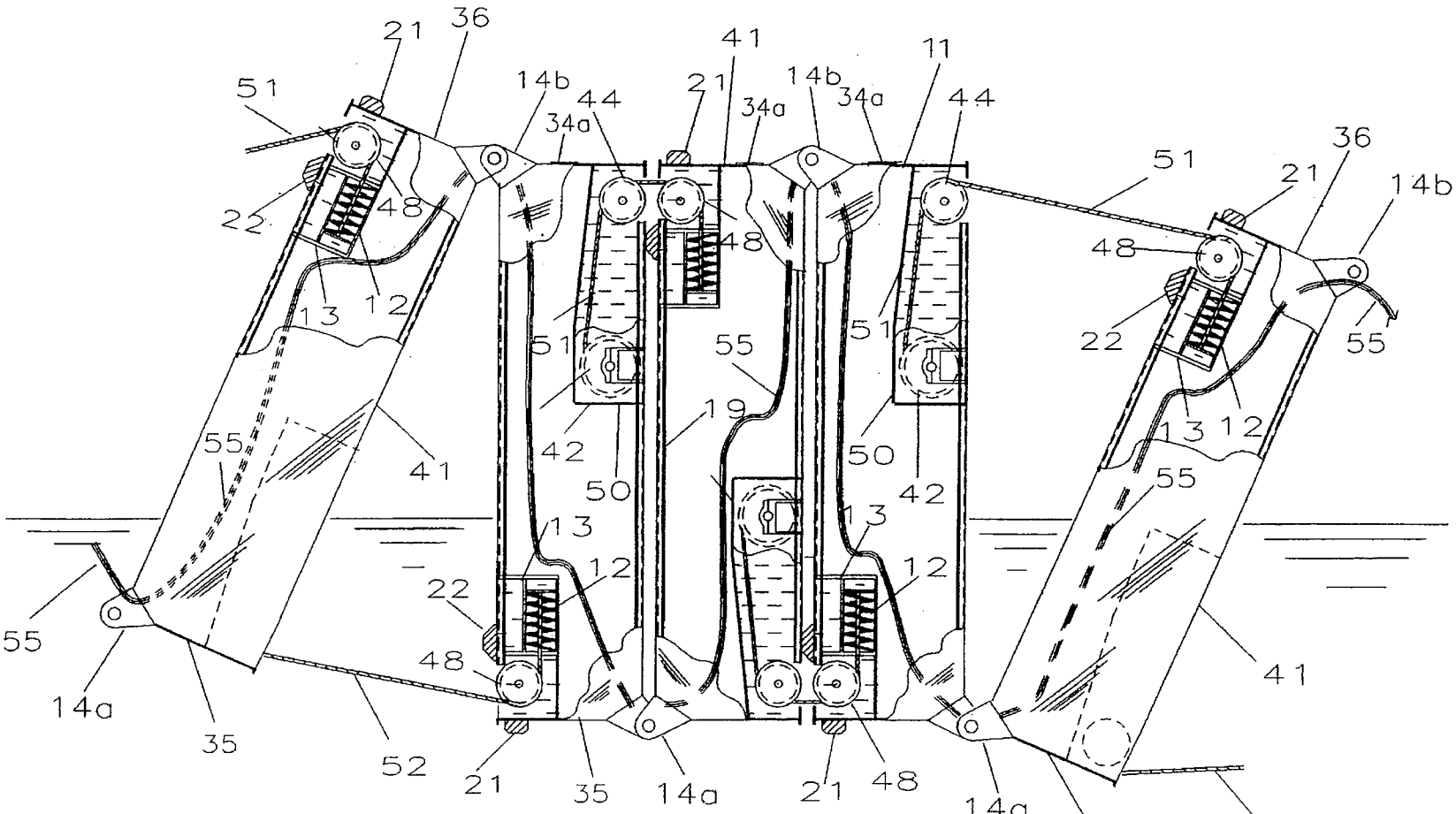
FIG. 9 illustrates a detailed cross section of hinged pontoon modules interconnected pivotally with wire rope actuation means constructed in accordance with the invention with side plates partially broken away to illustrate interior arrangement of individual modules during folding or unfolding operation.
Figure 10:
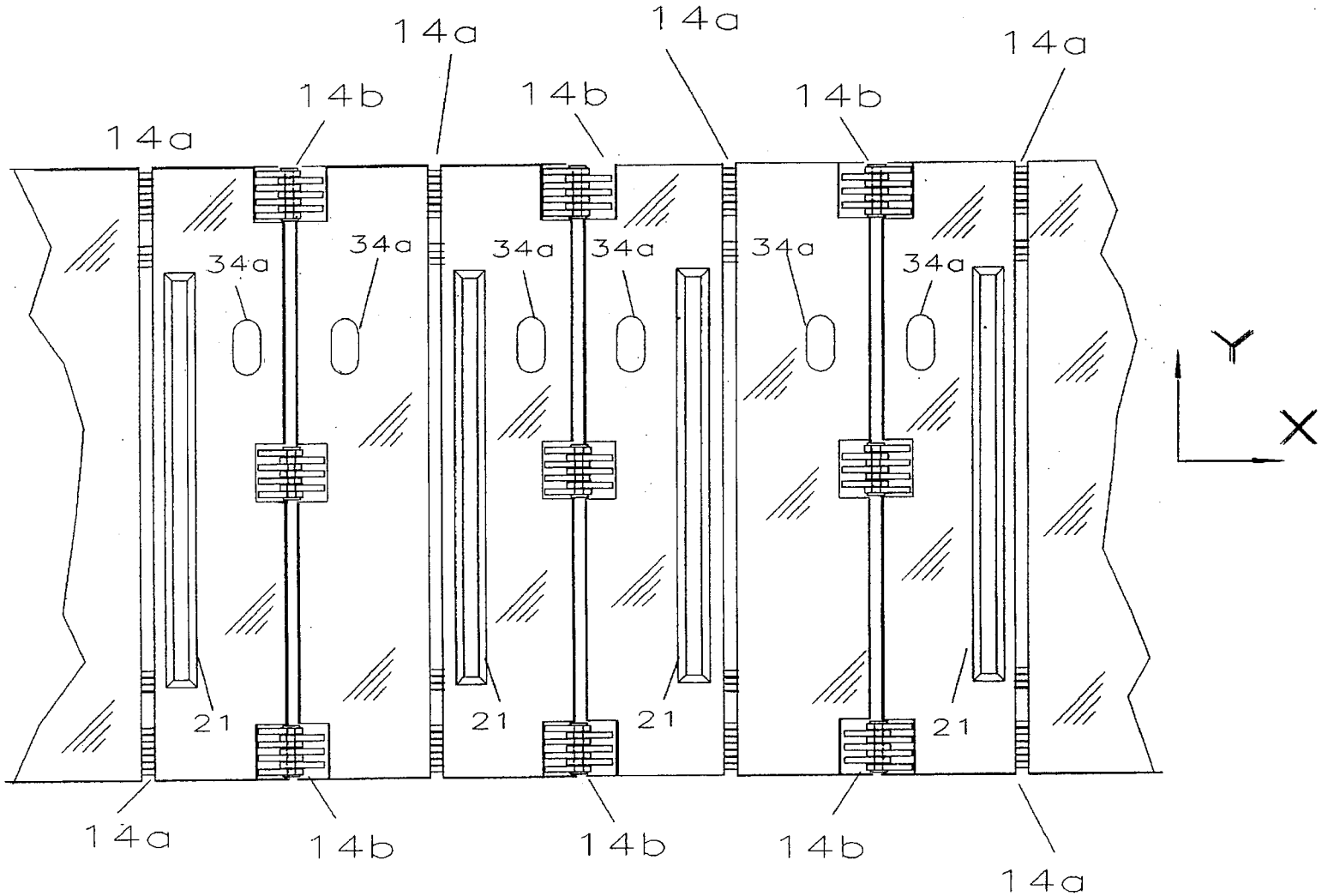
FIG. 10 shows top plan view of interconnected folded pontoon modules.

Pontoon modules when hinged together as shown in FIGS. 6,9 are functionally identical if turned 180 degrees about the pontoon longitudinal axis (x-axis) as shown in FIGS. 5, 7, and 8. This feature allows to utilize the bottom pontoon decks 25*b* to provide capability for wide vehicular roadway.

Each wire rope 51 and 52 are extended from winch wire drums 42 and led via sheaves 44 installed inside of watertight winch enclosures 50 with a direct access of wire rope through a port hole 32 and passing through a port hole 33 of the adjacent module and led over the sheave 48 (FIGS. 4,5,6,9) and secured to a shock absorber 12 installed inside of a flooded watertight shock absorber enclosure 13 as shown in FIGS. 4,6,9.

Each flooded watertight winch drum enclosure 50 provides unobstructed operation of winch rope with surrounding water through a port hole 32, and the port hole 33 in the adjacent pontoon module without causing flooding in the interior of each module as shown in FIGS. 4,6, and 9. Each winch enclosure 50 and shock absorber enclosure 13 are provided with a drain pipes (not shown).

Winch drums 42 mounted on drive shafts 11 are connected with flexible couplings 43 directly in synchronism to a gear box 46 and actuated by electric motor 47. Electric motor is provided with electric brake 53 as schematically shown in FIGS. 4,7,8. Bearing 49 shown in FIGS. 4,7,8 is used to support drive shaft 11. All pontoon modules are interconnected with flexible electrical and control cables 55 (FIGS. 4,9) which are linked to electric generator and control station located on pontoon carrier. Control station on the pontoon carrier permits to control all pontoon modules. Manual emergency actuation means 54 (schematically shown in FIGS. 4,7,8) installed in each module are used to actuate winch drums in emergency situation.

Figure 2:
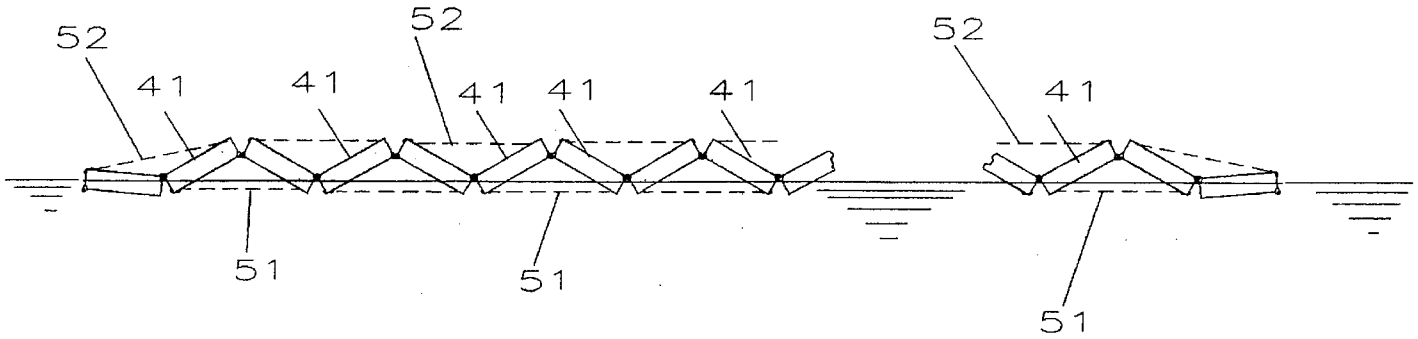
FIG. 2 illustrates a diagramatic side view of pivotally interconnected pontoon modules during the unfolding operation.
Figure 3:
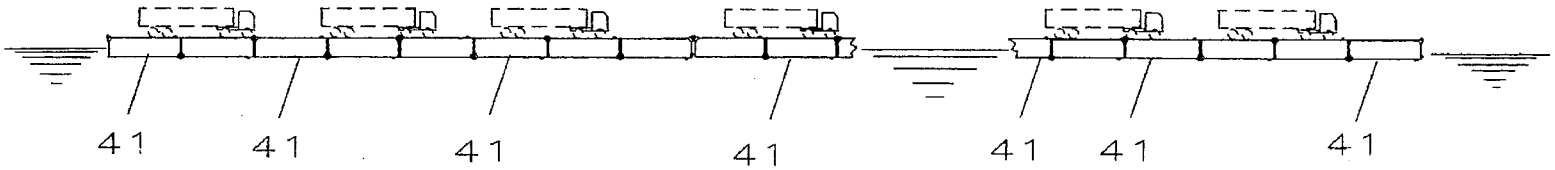
FIG. 3 shows a diagramatic side view of fully extended pontoon modules used during the vehicular traffic operation.

Each pontoon module is pivoted by means of winch wire ropes 51 and 52 led from winch drums 42 and led off the sheaves 44 through port holes 34 and connected to shock absorbers 12 in adjacent pontoon module (FIGS. 4,6,9). As the winch ropes are tightened, the module starts pivoting about hinges as shown in FIG. 9. Pivoting of each pontoon module during folding and unfolding operation is accomplished by top and bottom winch wire ropes 51 and 52, each pulling in the same direction as illustrated in FIGS. 2,9. This dual action of wire ropes provides each module with stable reinforced pivoting capability about the hinges and prevents from sudden unfolding of pontoon modules.

Wire ropes 51 and 52 extending from the winch drums 42 and connected to spring type shock absorbers 12 are subjected to continuously applied pretension forces provided by wire winches allowing the interconnected pontoon modules to function as a flexible system.

Differences in draft, list, and trim of individual modules are accomodated by hinges 14*a*,14*b* and 14*c*, fenders 21,22 and shock absorbers, 12 to avoid large vertical reaction forces in individual module structures subjected to vehicular loads when operating in the sea state environment. The FIGS. 6,7,8 and 9 illustrates pontoon modules connected with one another at the underside with hinges 14*b* and 14*c* and hinged together at the top side of adjacent modules with hinges 14*a*.

Elastic fenders 21 and 22 (FIGS. 5,6, and 9) installed on top and bottom decks 25*a* and 25*b* of pontoon modules provide flexibility in the articulated pontoon bridge arrangement capable to withstand operating impact loads during folding and unfolding operation of pontoon modules and vehicular loads when operating in the sea state environment.

Figure 1:
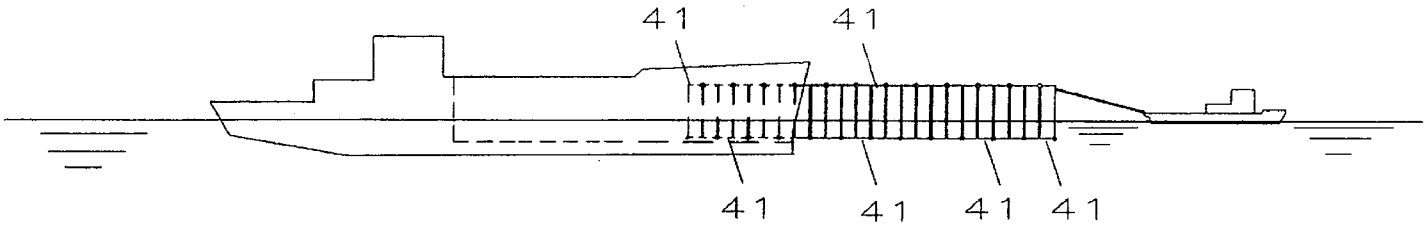
FIG. 1 illustrates a diagramatic side view of basic principle of folded pontoon modules arrangement being transported by pontoon carrier and towed out by a tug boat means.

There is shown in FIGS. 1 through 10 a typical embodiment of the folding pontoon assembly arrangement of the present invention. Folded interconnected pontoon modules 41, transported in a pontoon carrier and towed out by a tug boat are illustrated in FIG. 1.

The wire rope 51 and 52 operated pontoon modules are interconnected together so that they can progressively fold and unfold together as illustrated in FIGS. 2,6,9.

Unfolding operation of the pontoon modulus 41 as illustrated in FIG. 2. is commenced by gradually activating the wire winches 42 and gradual release of electric brakes 53 in each module to prevent impact loads between the modules. After the release of electric brakes 53, the pontoon modules tend to unfold by themselves due to couples created by gravity and buoyancy forces. Tension forces in wire ropes provided by winch pulling forces prevent slack occuring in the wire ropes and restrain the modules to unfold suddenly.

In order to commence the folding of pontoon modules from an extended position, a temporary service wire rope from the ship's deck winch (or crane) is attached to one of the end modules and pulled 8–10 feet upward thus creating a moment arm and enabling the module winch wire ropes to start pivotting first module. After pivoting of the end module is initiated, the service line is disconnected and folding operation is continued by gradually engaging the pontoon winches in succession. The pull in winch wire ropes 51 and 52 causes the modules to pivot about the hinges causing each module to rise and fold together into a vertical juxtaposition. Before the folding operation is completed, the operation of wire rope winches is maintained tightening the modules into a tight folded vertical juxtaposition arrangement, (FIGS. 1,10) and the wire winches are automatically stopped and electric brakes 53 in each folded module are automatically locked to secure the modules from unfolding.

To insure minimum pontoon operating electric power consumption, the pontoon modules are automatically folded in sequential order.

It will be understood that above description of the present invention is susceptible to various modification changes and adaptations.

What is claimed is:

1. A floating articulated pontoon arrangement comprising:

(a) plurality of pivotably hinged together interconnected buoyant watertight pontoon modules providing a vertically folded in juxtaposition assembly and unfolded extended pontoon modules assembly;

(b) each said pontoon module having generally rectangular shape;

(c) each said pontoon module comprises fully watertight welded structure, subdivided into a plurality of buoyant watertight compartments;

(d) each said pontoon module comprises top deck, bottom deck, end walls, side walls, transverse bulkheads, longitudinal bulkheads and winch wire cable troughs installed in the said top and bottom decks;

(e) top deck structure of each said pontoon module when in extended position has one or two way vehicular roadway capability;

(f) bottom deck structure of each said pontoon module has a vehicular roadway capability when turned 180 degrees about pontoon longitudinal axis;

(g) each said pontoon module is provided with hinged pivotable means;

(h) said pontoon modules are folded and unfolded using pivoting electromechanical actuation means installed in the interior of each said pontoon module;

(i) each said pontoon module comprises shock absorbers installed in the interior of each said pontoon module;

(j) each said pontoon module comprises fenders installed on said top deck, on said bottom deck, and on said end walls;

(k) said pivoting electromechanical actuation means installed inside of each said pontoon module comprises electric motor, electric brake, gear box, flexible couplings, driving shafts, electric and control cables, and manual emegency actuation means.

2. An arrangement as defined in claim 1 further comprising wire winch drums, wire ropes and sheaves installed inside of flooded watertight enclosures with direct access through a porthole to outside water environment.

3. An arrangement as defined in claim 2 wherein, in each said pontoon module the said wire rope winch drums are operatively connected with shafts to pivoting electromechanical actuation means.

4. An arrangement as defined in claim 3 wherein, said pivoting electromechanical actuation means of each said pontoon module are supplied with electric power from a shipboard supply main.

5. An arrangement as defined in claim 4 wherein, flexible electric and control cables interconnect all said pontoon modules are linked with pontoon carrier.

6. An arrangement as defined in claim 2 herein each said wire rope from said winch drum is led via said sheaves through a port hole with direct access into water environment and enters through port hole of adjacent said pontoon module and secured to said shock absorber.

7. An arrangement as defined in claim 6 wherein, each said winch wire rope is led from the outside water environment into said adjacent pontoon module via sheaves through port hole and connected to a said shock absorber enclosed in flooded watertight enclosure.

* * * * *